United States Patent [19]

Bründler

[11] 4,043,515

[45] Aug. 23, 1977

[54] MACHINE FOR COMMINUTING AND MIXING MATERIALS

[76] Inventor: Hans Josef Bründler, Buttikon, Switzerland, CH-8863

[21] Appl. No.: 568,417

[22] Filed: Apr. 16, 1975

[30] Foreign Application Priority Data

Apr. 25, 1974 Germany ..... 2420115

[51] Int. Cl.[2] ..... B02C 18/14

[52] U.S. Cl. ..... 241/97; 241/45; 241/154; 241/161

[58] Field of Search ..... 241/45, 58, 97, 154, 241/161

[56] References Cited

U.S. PATENT DOCUMENTS

| | | | |
|---|---|---|---|
| 1,017,213 | 2/1912 | Hottmann | 241/97 |
| 1,417,065 | 5/1922 | Hottman | 241/97 |
| 2,481,775 | 9/1949 | Offenhauser | 241/97 |
| 2,617,460 | 11/1952 | Levit | 241/97 |
| 2,730,931 | 1/1956 | Reisten | 241/97 |

*Primary Examiner*—Granville Y. Custer, Jr.
*Attorney, Agent, or Firm*—Ernest F. Marmorek

[57] ABSTRACT

A machine for the continuous comminution and mixing of materials, especially animal and vegetable media, has a mixing chamber in which two conveying passages are arranged. Each passage has a conveyor and mixer element working oppositely to one another, with each conveying passage there is associated a comminuting device which at the same time acts as a conveying means to deliver materials in the same direction as the associated conveying and mixing elements into the relevant conveying passage or respectively draw therefrom. Reversing spaces or passages serve together with these passages for the circulation of the mixed material.

16 Claims, 11 Drawing Figures

Relation of Volumes larger than same size as same size as

MACHINE FOR COMMINUTING AND MIXING MATERIALS

INTRODUCTION AND BACKGROUND OF THE INVENTION

The invention relates to a machine for the continuous comminution and mixing of materials, especially animal and vegetable media, comprising a mixing chamber in which two conveying passages are arranged each having a conveyor and mixer element, these working in opposite directions, and a comminuting device arranged on one end of these passages.

Prior machines are known, wherein a coarse comminutor is arranged on one end of the conveying and mixing chamber and a very fine comminutor is arranged on the other end. The coarse comminutor consists of cutters fitted radially on a rotating shaft. In the conveying and mixing chamber two trough-like passages lie side by side, the conveyor worms lying therein are formed so that the mixed material is conveyed in opposite directions in the two passages. Thus the one worm feeds the material to the coarse comminutor, the other worm takes over the material or draws it away. The movement of the mixed material is thereby influenced by the conveyor elements. In this known machine there is in a certain sense a circulation. As the conveyor and mixer elements and the coarse comminutor are not adapted in capacity and action to one another for the purpose of circulation, the disadvantage arises for example that a part of the mixed material remains for a lengthy time in the coarse comminutor. This results in undesired heating of the mixed material due to repeated cutting and the different levels of low resistance. An unnecessarily great power requirement is caused by these points of stoppage or accumulation. A time delay also occurs if the cutting and conveying means are not adapted to one another in the cycle. This problem especially occurs in the known apparatus which have the diameter of the coarse comminuting device very much greater than the diameters of the conveying passages and of the mixing and conveying elements arranged therein.

An object of the invention to adapt the comminuting device, the reversing spaces and conveying passages and the conveying and mixing elements to one another in such a manner that the material worked is conducted in a cycle so that with minimum power requirement a comminution and mixing take place rapidly. It is a second object to avoid stoppages and accumulations within this cycle to thereby avoid undesired heating of the mixed materials.

BRIEF SUMMARY OF THE INVENTION

The solution of the problem according to the invention consists in that with each conveying passage there is associated a comminuting device which is both a conveying means which delivers into and draws from its associated conveying passage in the same direction as the associated conveyor; and mixer elements. These, in cooperation with the reversing spaces at the beginning and end of the conveying passages act together to circulate the mixed material.

This measure achieves the object that the material is conveyed and comminuted simultaneously at the comminution points of the mixed material. Stoppages and accumulations are thereby avoided and the power requirement is thereby reduced.

FURTHER DESCRIPTION AND ADVANTAGES OF THE INVENTION

In another embodiment of the invention the conveying means are arranged separately from the comminuting device in the reversing spaces.

Due to this measure it is possible to separate the comminuting device and the conveying means from one another in the reversing space.

Other embodiments include provisions for both of the comminuting devices with their conveying means to be arranged side by side on one end of the conveying passages.

A still further embodiment provides for the comminuting devices with their conveying means to be arranged staggered in relation to one another at opposite ends.

It is also essential that fittings which reduce the circulation flow resistance, for example baffle plates, are provided in the reversing spaces.

To further reduce the flow resistance during circulation of the material in the device, the diameters of the conveying and mixing elements can preferably be approximately of the same size as the diameters of the associated cutter blades and also approximately correspond to the size of the connecting openings. By this means optimum pressure conditions can be achieved for the mixed material at every point of the cycle.

It is also essential that, if the comminuting device is formed by cutters, these are of crescent-shaped formation and secured on one axis, and are so asymmetrically ground and arranged that they are used at the same time as conveying means.

BRIEF DESCRIPTION OF THE VIEWS IN THE DRAWINGS

The invention will be explained in greater detail hereinafter with further features, by reference to an example of embodiment which is illustrated in the accompanying drawings, wherein:

FIG. 1 shows a front elevational view of a machine for the continuous comminution and mixing of materials, FIG. 2 shows an end elevational view of the same machine in the direction of the arrow II in FIG. 1, with end plate and gear space omitted, FIG. 3 shows a front elevational view of another embodiment of the machine with the side plate omitted, FIG. 4 shows a sectional view along the line IV—IV in FIG. 3, FIG. 5 shows an end view of a half of each type of cutter head, FIG. 6 shows a side view of the same embodiment, FIG. 7 shows the cutting edges of the cutters of each type of cutter head, on a larger scale, FIG. 8 shows a longitudinal section on a larger scale through the attachment coupling of the fine comminutor, FIG. 9 shows a diagrammatic drawing of the volumetric measurement system, FIG. 10 shows an illustration of a variant of embodiment, corresponding to FIG. 3, and FIG. 11 shows the circulation system diagrammatically.

DETAILED DESCRIPTION OF THE PREFERRED EMBODIMENTS

Figure 1:
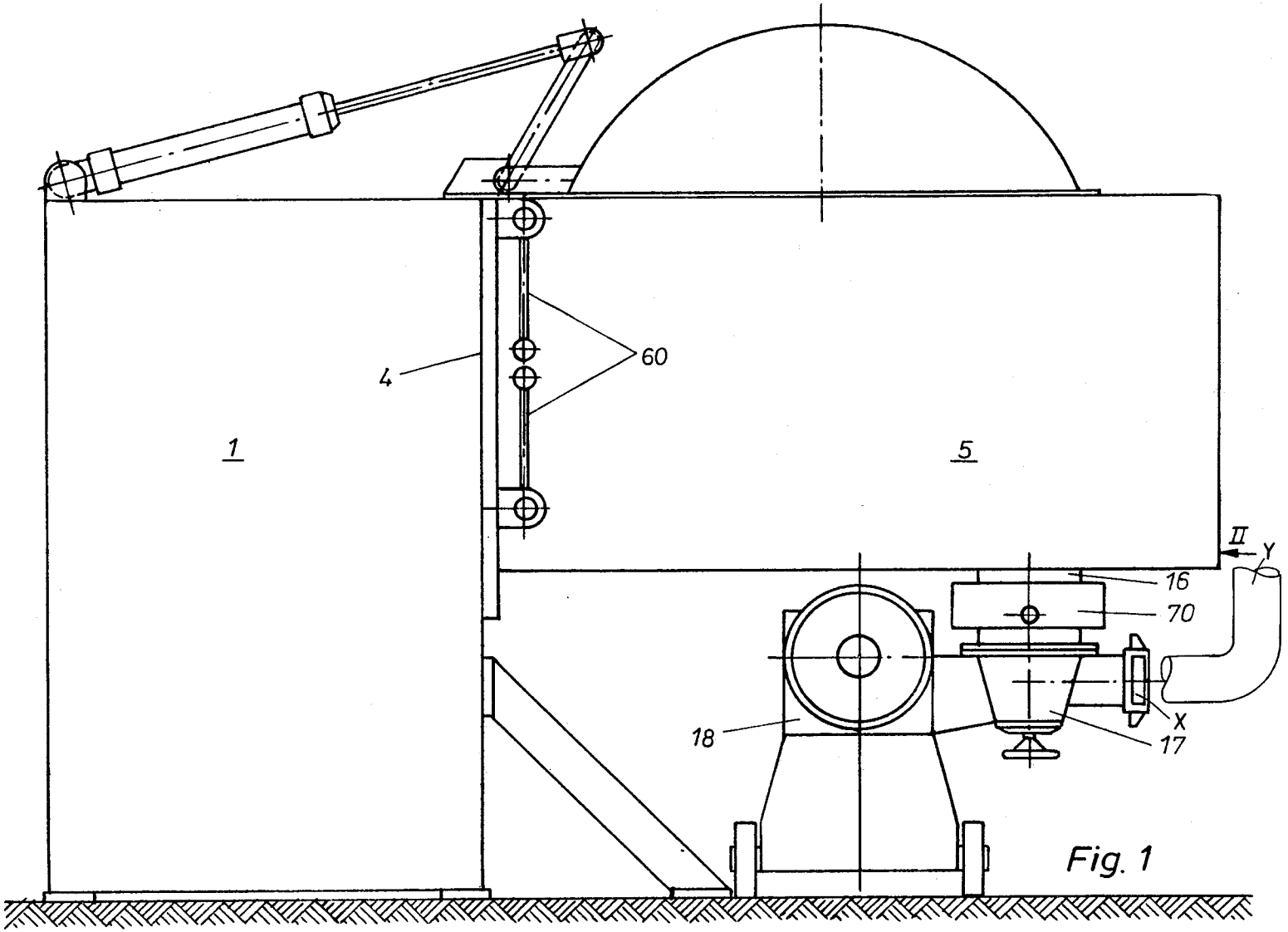
Figure 3:
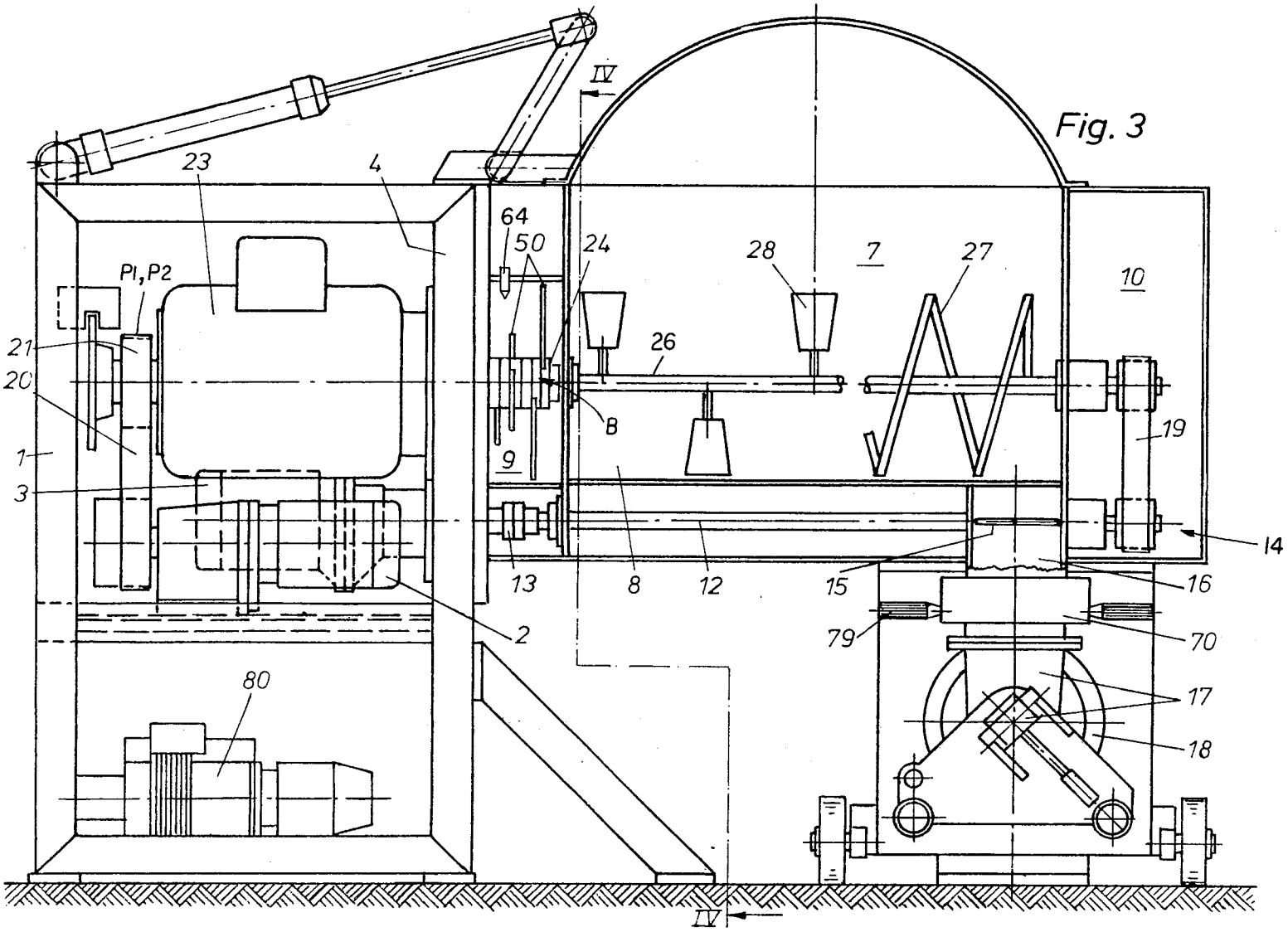

In the drawings, the drive housing 1 stands firmly on the floor and includes drive motors 23 for the coarse comminutor 50 and two drive motors 3, one for each mixer and conveyor element. Additionally, a geared drive motor 2 is provided for driving at very low speeds (FIG. 3). The drive shafts of these drive motors extend beyond the wall 4 to which the working housing 5, as shown in FIG. 1, is pivotably secured by means of the two hinge joints 6. This working housing 5 comprises the mixing space 7 with two mixing and conveying passages 8 (FIG. 3), which on the one end is preceded by the space 9 with the coarse comminutor blades 50 and on the other end is followed by the space 10 with a gearing or power transfer unit 14. Each shaft 26 of the mixing elements 27, 28 (to be described later) is coupled by a belt 19 to each motor 3 through its associated shaft 12 and its associated coupling 13.

Figure 10:
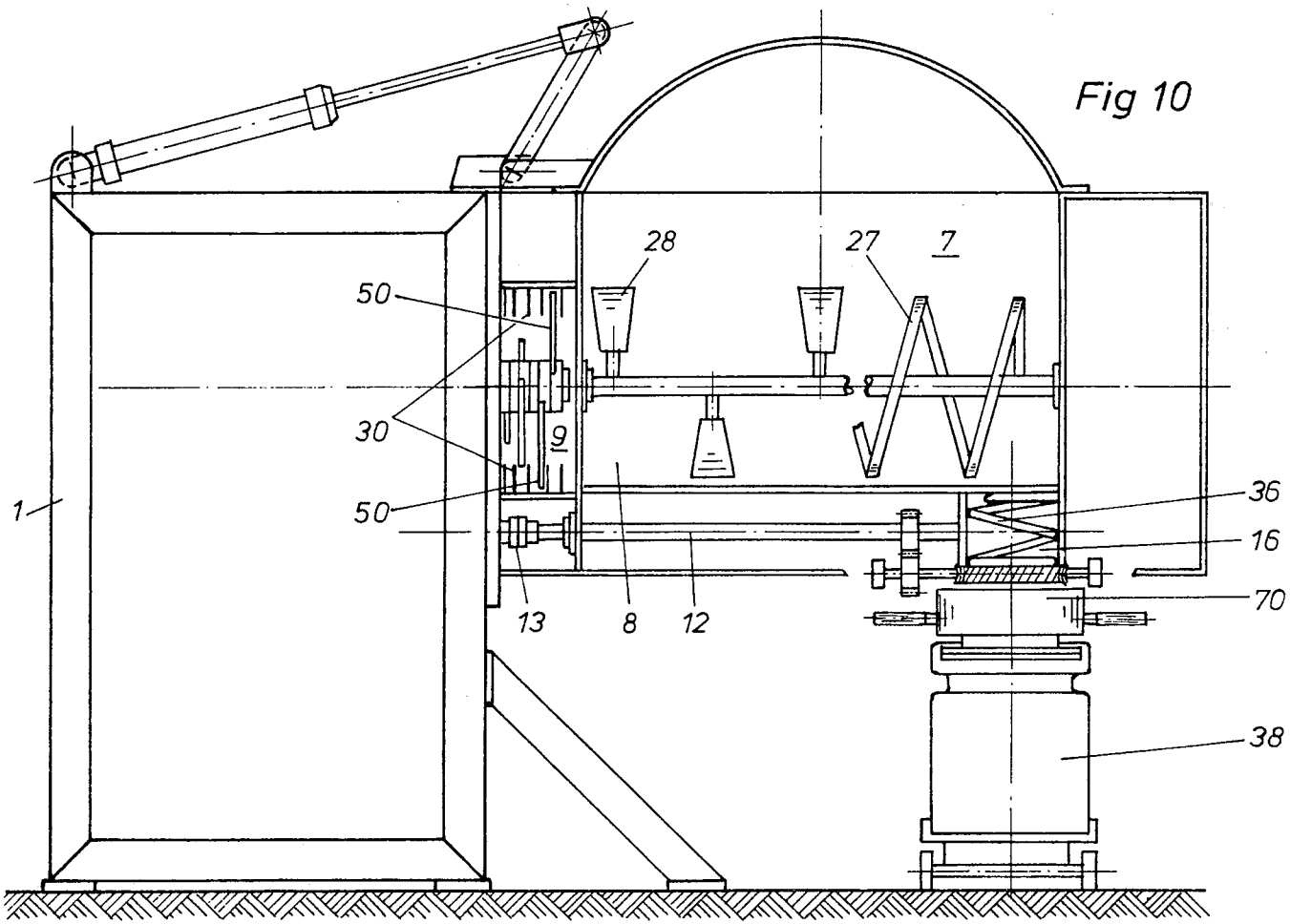

On the side of the mixing and conveying space 7 opposite to the space 9 which houses the coarse comminutor blades 50 there is provided an outlet 16. Passage of material through outlet 16 is controlled by a slide valve 15 (FIG. 3) or a conveyor worm 36 (FIG. 10). The outlet is connected through a vertically adjustable connecting coupling 70 with the fine comminutor 17 and the mincer 18 (FIGS. 1-3) or the container 38 (FIG. 10) for sample-taking.

Figure 2:
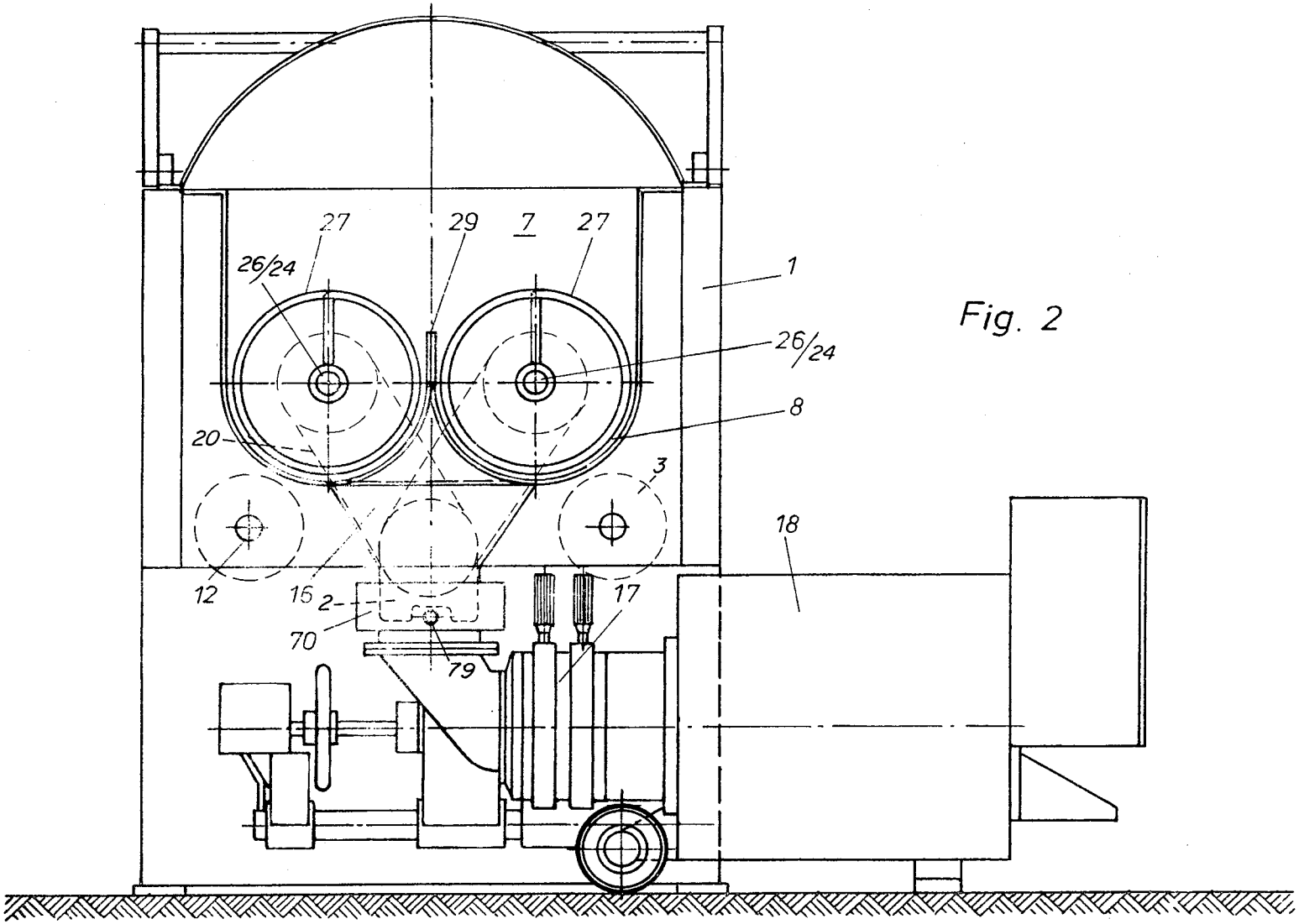
Figure 4:
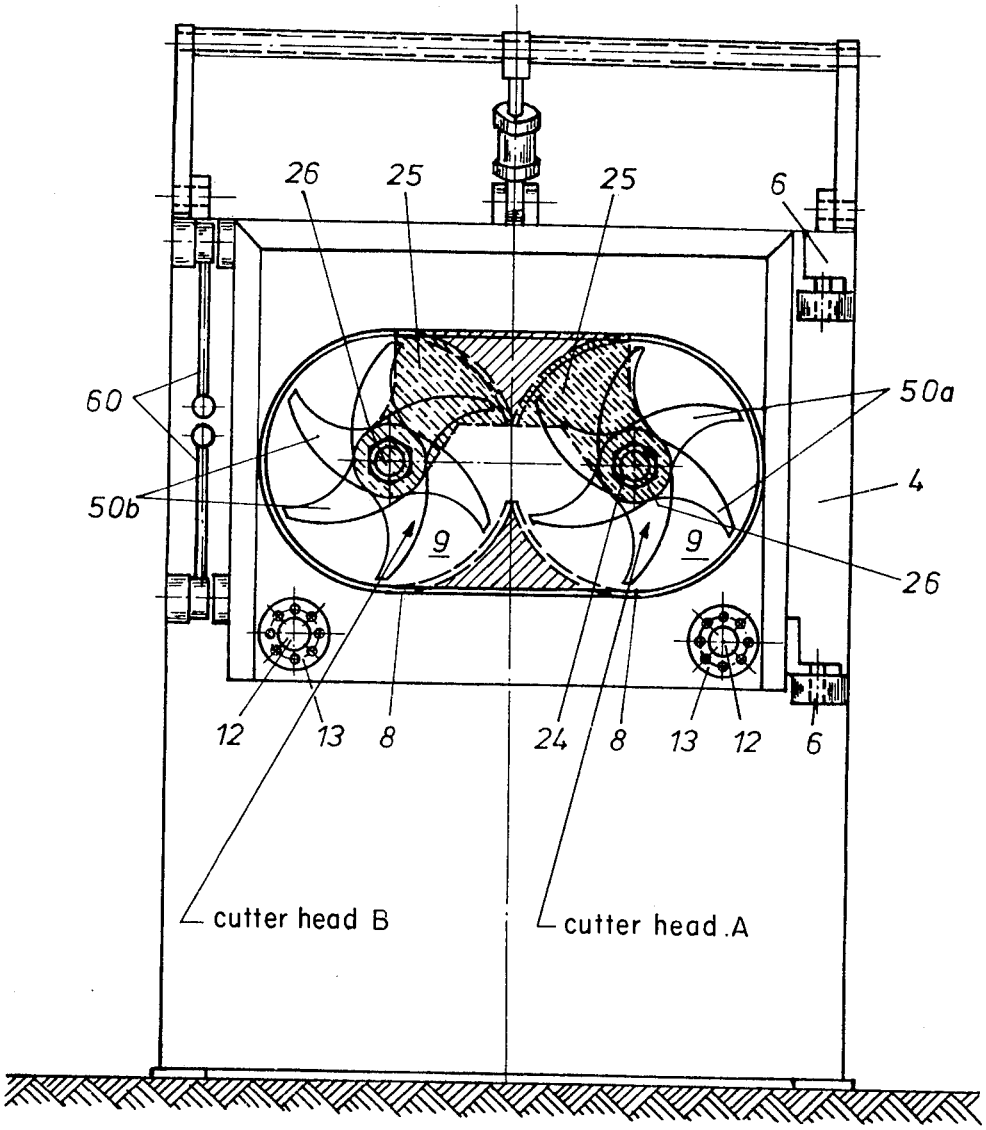

The geared drive motor 2 drives two toothed belt pulleys $P_1$, $P_2$ connected with the shafts 24, through one or two coaxial toothed belt pulleys, in each of which a unidirectional clutch 21 is mounted; and through two toothed belts 20 (FIG. 2). On the opposite side of the shaft 24 are the cutter heads A and B (FIG. 4). Each cutter head A and B has a readily directed crescent-shaped cutter 50, which together form the coarse comminutors. The crescent-shaped cutters 50 are of such size that together the cutter heads A and B sweep practically the entire space 9, and the peripheral lines of the blade tips of cutters 50 are approximately in contact.

The cutter heads A and B which are mounted on the cutter shafts 24 can thus be driven either by the motors 23 to one or more high rotation speeds, whereby the comminuting blades 50 effect a comminuting action upon the treated material, or by the geared drive motor 2, whereby the blades 50 act with one or more lower rotation speeds only as mixing elements upon the treated material.

In order not to interfere with the function of the two drives, over-running freewheels or unidirectional clutches 21, as are well known in the art are built into the drive toothed belt pulleys $P_1$, $P_2$. The blades 50 lie in several planes one behind the other. Baffles 30 (FIG. 10) may be fitted between the blades 50 to increase the cutting effect and mixing effect of the blades by restraining movement of the material when the blades 50 are rotated.

Figures 5, 6, 7:
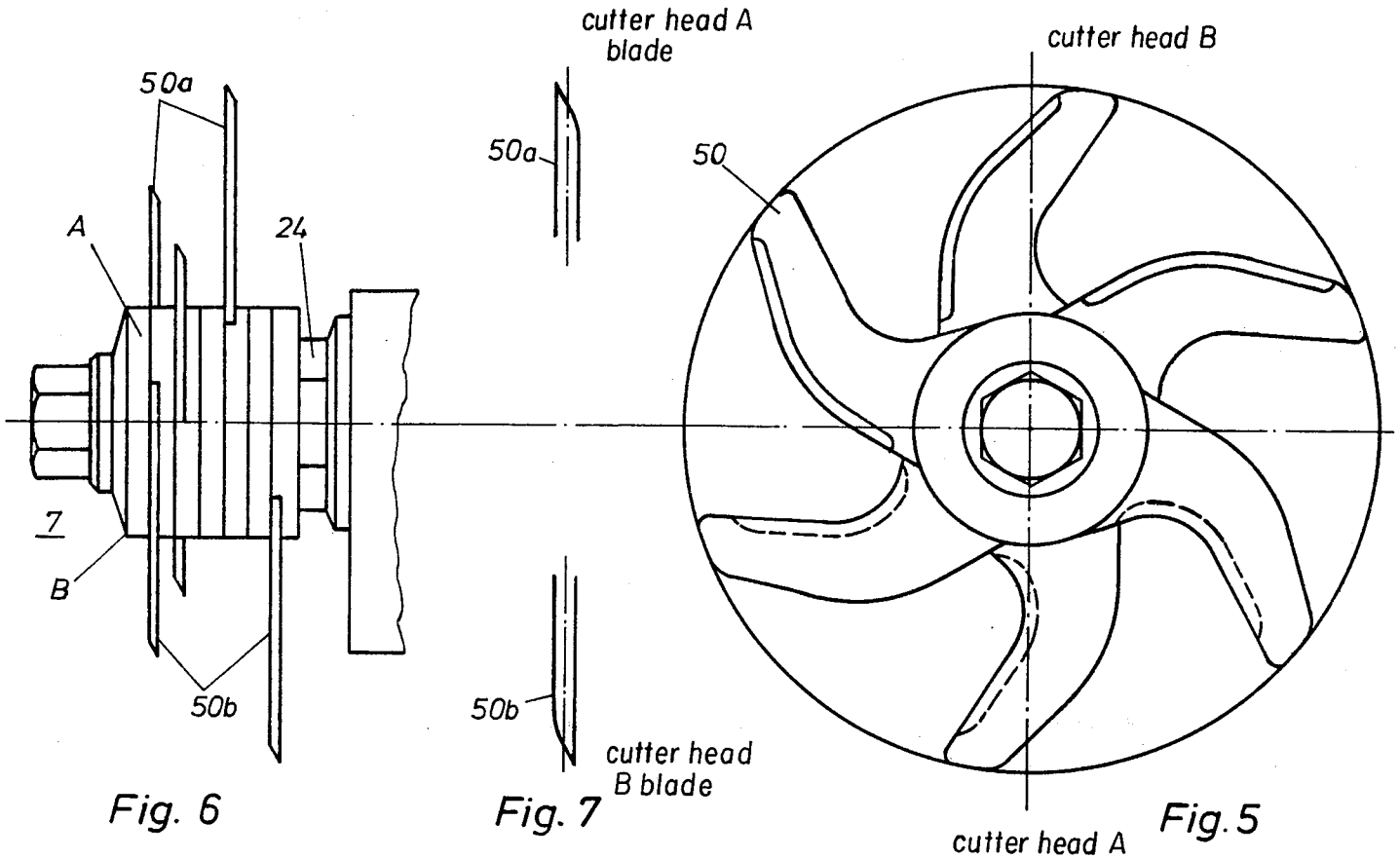
Figure 8:
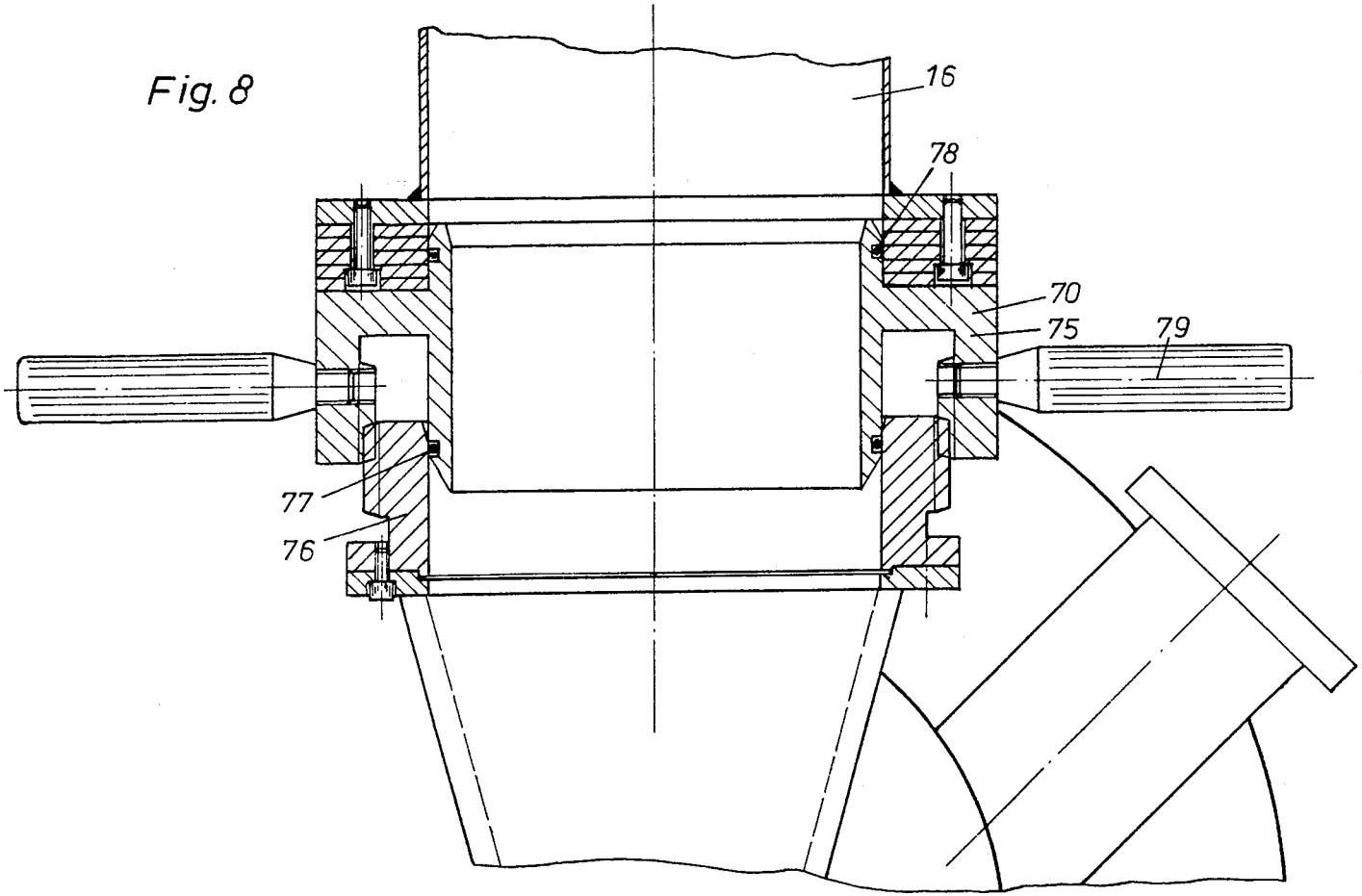

In the example of embodiment shown in FIG. 4, the coarse comminutor with the cutter head A acts to exert a suction effect. Its blade edges extend radially on the side facing the mixing space 7, while on the rear side the blade edge is slightly bevelled. The blade edges of the blades of the left cutter head B of the coarse comminutor are conversely ground. The conveying directions and the corresponding beveling on the blades may be seen from FIGS. 5 to 7. Naturally the different types of beveling do not, alone, suffice for satisfactory working of the machine. The material to be cut must also be conveyed into and withdrawn from the comminutors by means of conveyor elements.

These conveyor elements are seated on the shafts 26 and can consist of a worm 27 or blades 28 or both in combination. The worm is more effective for conveying the material to be worked. The blades are more effective for mixing the material. The drive of the shafts 26 takes place from the shaft 12 through the belt drive systems 19. The circle swept by the mixing and conveying elements 27, 28 (See FIG. 3) conforms approximately with the internal space 9 of the coarse comminutor. In each case a shaft 24 of the coarse comminutor lies in alignment with a shaft 26 of the mixing and conveying elements. The passages 8 which form the bottom of the mixing space 7 are also situated coaxially therewith. These passages are separated by a center wall 29 (FIG. 2). Guide plates 25 may also be provided in the space 9 (FIG. 4) and act to influence the flow of material to be worked in the coarse comminutor space as discussed below.

The medium or material to be worked is charged into the mixing space 7, whereupon a negative pressure is generated there. The mixing element 27, 28 by rotating, simultaneously mixes and conveys the medium against its associated cutter head B, where it is cut and conveyed to behind the cutting edges. At the same time the cutters force the medium against the side walls. As it can escape only sideways towards the other cutter shaft, it is taken up by the second coarse comminuting assembly, again cut by the cutter head A and then fed to the second conveyor and mixer element, as a result of the shaft or beveling of the blade. This movement of the medium in the space 9 of the coarse comminutor is also reinforced by the built-in guide plates 25. Baffles 30 (FIG. 10) can also be arranged to promote the cutting process by restraining the material from moving as the blades 50 rotate.

Figure 11:
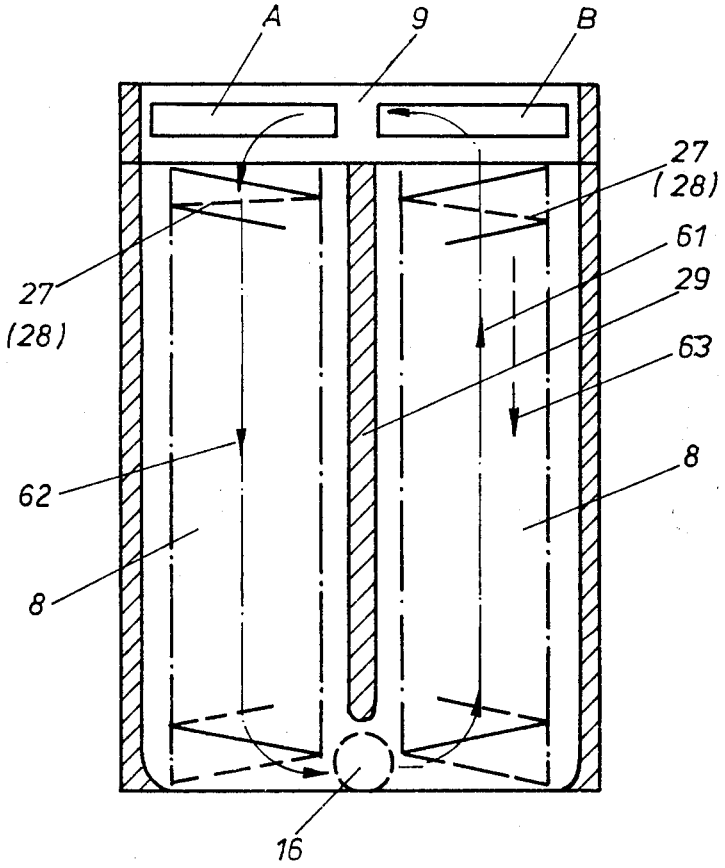

Now the second conveyor and mixer element 27, 28 conveys the medium, with simultaneous mixing, to the other end of the mixing space. If the outlet opening is closed, the medium passes for repeated working into the first passage with the first conveying and mixing element 27, 28 (FIG. 11). This takes place until the sample withdrawn by means of the sample-taker 38 shows the correct degree of mixing and fineness, whereupon the medium passes into the very fine comminutor 17 and then away to the discharge device.

The blade tips can partly overlap one another. The important point is that the diameters of the conveyor and mixer elements 27, 28 and thus also the ideal diameters of the passages 8 are approximately of the same size as the diameters of the associated cutter blades **50*a*, 50*b*** and that these diameters also correspond approximately to the size of the connecting openings.

In practice, it has been found that an apparatus, according to the instant invention, can work continuously or intermittently as required. As a result of the design of the device, only the cutter blades 50, appear to be subject to heavy wear and must be sharpened or replaced periodically. Replacement of the cutter blades **50*a*, 50*b* is facilitated by releasing the levers 60 which permit the working housing 5 to be pivoted out around hinges 6 so that the cutters 50** are exposed for replacement.

To aid the cutting and mixing process and also to remove the heat occurring in the coarse comminutor, injection nozzles 64 for hot or cold water or steam may be provided in the space 9 of the coarse comminutor above the cutters 50. These injector nozzles 64 are preferably directed radially of the shaft of the coarse comminutor.

The machine can also be supplemented by several additional elements. The very fine comminutor 17 can be a continuous comminuting machine that may be supplemented by a mincer 18.

To promote the starting up and emptying of the machine, a rising pipe Y with vacuum effect can be arranged at the outlet X and after the very fine comminutor 17 (FIG. 1).

The very fine comminutor 17 and the container 38 for sample-taking are capable of being slid into position and removable, but must be attachable in airtight manner to the outlet 16 of the mixing space 7. The vertically adjustable coupling 70 consisting of the rotatable sleeve 75, serves for this purpose. This sleeve is fitted for screwing to the collar 76 of the part 17, 38 to be attached, but seals with this collar 76 by means of the O-ring 77, while another part of the sleeve 75 is introduced into the outlet 16, where a sealing O-ring 78 is likewise arranged. 79 designates the handles.

Figure 9:
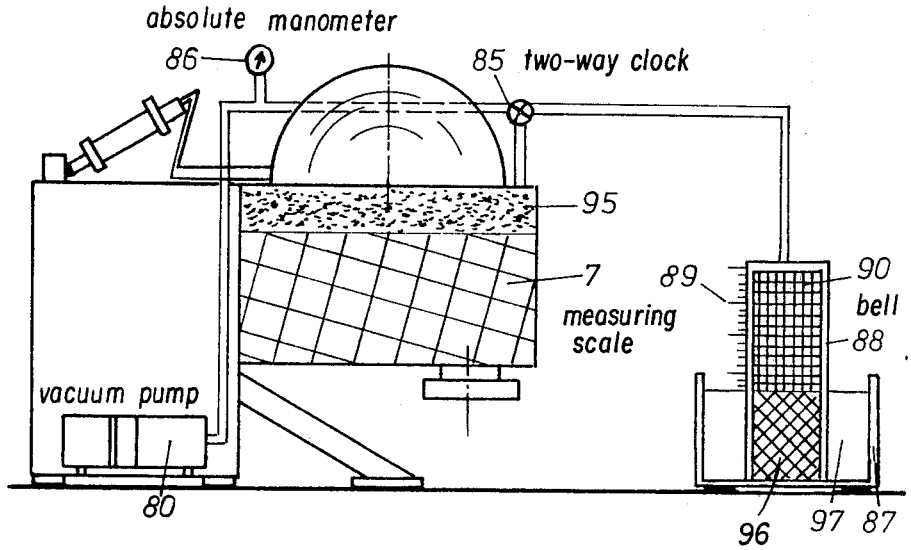

As FIG. 9 shows, a volumetric measuring system can also be attached to the machine. This system consists of the vacuum pump 80, which is connected through the two-way cock 85 with the mixing space 7. In this conduit, there is an absolute manometer 86. The two-way cock 85 also connects the mixing space with the measuring device, which consists of an open, liquid-filled vessel 87 into which a bell 88 is inverted. The internal space of the bell has an opening which permits inflow of the liquid of the vessel 87. If now the negative air pressure in the mixing space is to be measured, the two-way cock is shifted over. The vacuum in the mixing space 7, produced therein by the pumps 80 when the connection is established by the cock 85 extends into the bell 88 and draws in liquid. The pressure can be read off on the measuring scale 89.

This volumetric measuring system can be coupled with a computer, to control the starting of the programme.

In FIG. 11 the same numerals designate the same parts. In the circulation the mixed material is conveyed in the directions of the arrows 61, 62. By reversing a motor 3, the direction of conveying in the one conveying passage 8 of the conveying and mixing elements provided there, the direction of the arrow 61 can be reversed for discharge into the direction of the arrow 63, so that then both comminuting and conveying devices convey in the same direction to the outlet 16.

What is claimed is:

1. A machine, for use in continuously comminuting and mixing materials, especially animal and vegetable products, comprising in combustion, a mixing chamber structure including adjacent first and second mixing chamber portions, a first connecting passage at one end of said mixing chamber and interconnecting said first and second mixing chamber portions, and an unobstructed second connecting passage at the other end of said mixing chamber interconnecting said first and second mixing chamber portions free from obstructions, two comminuting devices disposed adjacent each other near said one end of said mixing chamber and a conveying and mixing means extending through the respective mixing chamber portion from each comminuting device, said comminuting devices and conveying and mixing means being operative to comminute and mix and convey said materials so as to convey them in an endless path throughout the first mixing chamber portion, thence through said second connecting passage into said second mixing chamber and thence through said comminuting devices and said first connecting passage and again into said first mixing chamber portion.

2. A machine according to claim 1, characterised in that the conveying and mixing means and the comminuting devices are independently driven.

3. A machine according to claim 2, characterised in that the conveying and mixing means and the comminuting devices are each operably connected to driven shafts disposed in said mixing chamber structure.

4. A machine according to claim 1, comprising baffle plates, provided in said first connecting passage.

5. A machine according to claim 1, wherein the diameters of the conveying and mixing means are approximately of the same size as the diameters of the comminuting devices and in that these diameters also approximately correspond to the size of the first connecting passage.

6. A machine according to claim 1, wherein said second comminuting device exerts a suction effect and said first comminuting device a thrust effect.

7. A machine according to claim 1, wherein said comminuting devices comprise blades of crescent-type formation secured on a shaft lying coaxially with its respective conveying means and are asymmetrically ground.

8. A machine according to claim 7, characterised in that the circles of rotation of the blade tips of the two comminuting devices are in contact with one another said blade tips being off-set from one another.

9. A machine according to claim 7, characterised in that the circles of rotation of the blade tips of the two comminuting devices intersect said blade tips being off-set from one another.

10. A machine according to claim 7, characterised in that the shafts of the comminuting devices rotate in the same direction.

11. A machine according to claim 7, characterised in that the shafts of the comminuting devices rotate in opposite directions.

12. A machine according to claim 1, further comprising flow-influencing guide plates arranged in working relation to the comminuting devices.

13. A machine according to claim 1, further including an outlet opening closable by a slide valve said outlet being in said second connecting passage for removal of material from the second connecting passage.

14. A machine according to claim 13, further comprising an outlet opening including a vertically adjustable coupling, said outlet being in said second connecting passage.

15. A machine according to claim 13, further including a feeder element operable to convey the material to a very fine comminutor disposed near the outlet opening.

16. A machine according to claim 1 further including injection nozzles for hot or cold water or steam above the comminuting devices.

* * * * *